United States Patent [19]

Anno et al.

[11] Patent Number: 4,712,517

[45] Date of Patent: Dec. 15, 1987

[54] CYLINDER BLOCK STRUCTURE FOR MULTICYLINDER INTERNAL COMBUSTION ENGINES

[75] Inventors: Nobuo Anno; Takeo Arai, both of Saitama, Japan

[73] Assignee: Honda Giken Kogyo Kabushiki Kaisha, Tokyo, Japan

[21] Appl. No.: 807,995

[22] Filed: Dec. 12, 1985

[30] Foreign Application Priority Data

Dec. 13, 1984 [JP] Japan ..... 59-263665
Dec. 13, 1984 [JP] Japan ..... 59-189439[U]

[51] Int. Cl.[4] ..... F02B 75/18
[52] U.S. Cl. ..... 123/41.74; 123/195 R
[58] Field of Search ..... 123/195 R, 41.74, 41.79

[56] References Cited

U.S. PATENT DOCUMENTS 3,977,385 8/1976 Mansfield ..... 123/195 R
4,515,112 5/1985 Tsuchiya et al. ..... 123/195 R

FOREIGN PATENT DOCUMENTS 2044852 10/1980 United Kingdom ..... 123/195 R
2150635 7/1985 United Kingdom ..... 123/195 R

*Primary Examiner*—William A. Cuchlinski, Jr.
*Attorney, Agent, or Firm*—Lyon & Lyon

[57] ABSTRACT

A cylinder block structure of a light alloy for use in a multicylinder internal combustion engine includes a cylinder-defining portion having a plurality of cylinder bores with a water jacket defined in surrounding relation to the cylinder bores, and a crankcase-defining portion integrally formed with the cylinder-defining portion and having a plurality of integral journal walls spaced in the direction in which the cylinder bores are arranged. Concavities are defined in opposite sides of the cylinder- and crankcase-defining portions between the adjacent cylinder bores, the concavities lying between the water jacket and journal walls. A plurality of reinforcing rib systems project from the opposite sides of the cylinder block and each rib system surrounds one of the concavities. The concavities reduce the amount of molten metal to be poured in casting the cylinder block structure, for thereby preventing casting defects such as cavities from being produced in the cylinder block. The reinforcing rib systems serve to provide the required degree of stiffness to the cylinder block. Since the reinforcing rib systems terminate short of the deck of the cylinder block, no vibration is transmitted through the reinforcing rib systems to the deck, whereby the deck is prevented from being subject to deflecting vibration.

3 Claims, 5 Drawing Figures

CYLINDER BLOCK STRUCTURE FOR MULTICYLINDER INTERNAL COMBUSTION ENGINES

BACKGROUND OF THE INVENTION

The present invention relates to a cylinder block structure for use in a multicylinder internal combustion engine.

One general approach to improve the performance of an internal combustion engine is to reduce the weight of the engine and increase the mechanical strength thereof to enable the engine to withstand high loads, so that the engine can produce a high power output for its weight and therefore it produces good fuel economy.

It is well known that the weight of an internal combustion engine can be reduced by casting its major structural component, the cylinder block, of a light alloy such as an aluminum alloy, as disclosed in U.S. Pat. No. 4,515,211 corresponding to Japanese Laid-Open patent publication No. 58(1983)-74851 published May 6, 1983. Since a light alloy is lower in mechanical strength than an iron alloy, it has been customary to form those portions that are subject to high loads, such as journal walls supporting the crankshaft, as thick walls or solid blocks for increased mechanical strength. Cylinder blocks of a light alloy are generally manufactured by the die-casting process. Since the molten metal solidifies at a high speed in the die-casting process, the thick walls or solid blocks formed of a large amount of molten metal tend to solidify at relatively widely different speeds at their different portions, resulting in casting defects such as voids or cavities produced therein. However, if the thick walls and solid blocks are eliminated from cylinder blocks, then the rigidity of the cylinder block normally would be reduced.

Another well known way of reinforcing cylinder blocks cast of a light alloy for producing greater rigidity and operation reliability has been to add reinforcing ribs to the cylinder blocks at portions where the mechanical strength is weaker than other portions, as shown in U.S. Pat. No. 3,977,385.

SUMMARY OF THE INVENTION

It is an object of the present invention to provide a cylinder block structure for multicylinder internal combustion engines which is lightweight, sufficiently mechanically strong to accommodate high engine speeds and high power outputs, and is substantially free of casting defects when it is die-cast.

Another object of the present invention is to provide a novel form of cylinder block structure for multicylinder internal combustion engines which is provided with unique reinforcing ribs for increased rigidity, vibration resistance, and durability.

According to the present invention, a cylinder block structure of a light alloy for use in a multicylinder internal combustion engine includes a cylinder-defining portion having a plurality of cylinder bores and a water jacket defined in surrounding relation to the cylinder bores, and a crankcase-defining portion integrally formed with the cylinder-defining portion and having a plurality of integral journal walls spaced between the cylinder bores. Concavities are defined in opposite sides of the cylinder- and crankcase-defining portions between the adjacent cylinder bores, the concavities located vertically between the water jacket and the journal walls. A plurality of reinforcing rib systems project from the opposite sides of the cylinder block surrounding the concavities. The concavities reduce the thick walls and solid blocks in the cylinder block where a large amount of molten metal would be required during the casting process. When casting the cylinder block, therefore, the molten metal can solidify at a relatively uniform speed thereby eliminating casting defects, such as cavities, in the cylinder block. The reinforcing rib systems terminate short of the deck of the cylinder block and thus prevent any vibration of the cylinder block from being transmitted therethrough to the deck. The cylinder block structure of the invention is lightweight, compact, rigid, vibration-resistant, and durable. An internal combustion engine incorporating this cylinder block structure is sufficiently mechanically strong to accommodate higher operation speeds and higher power outputs and also is sufficiently lightweight to improve the fuel economy.

The above and other objects, features and advantages of the present invention will become more apparent from the following description when taken in conjunction with the accompanying drawings in which a preferred embodiment of the present invention is shown by way of illustrative example.

DESCRIPTION OF THE PREFERRED EMBODIMENT

Figure 1:
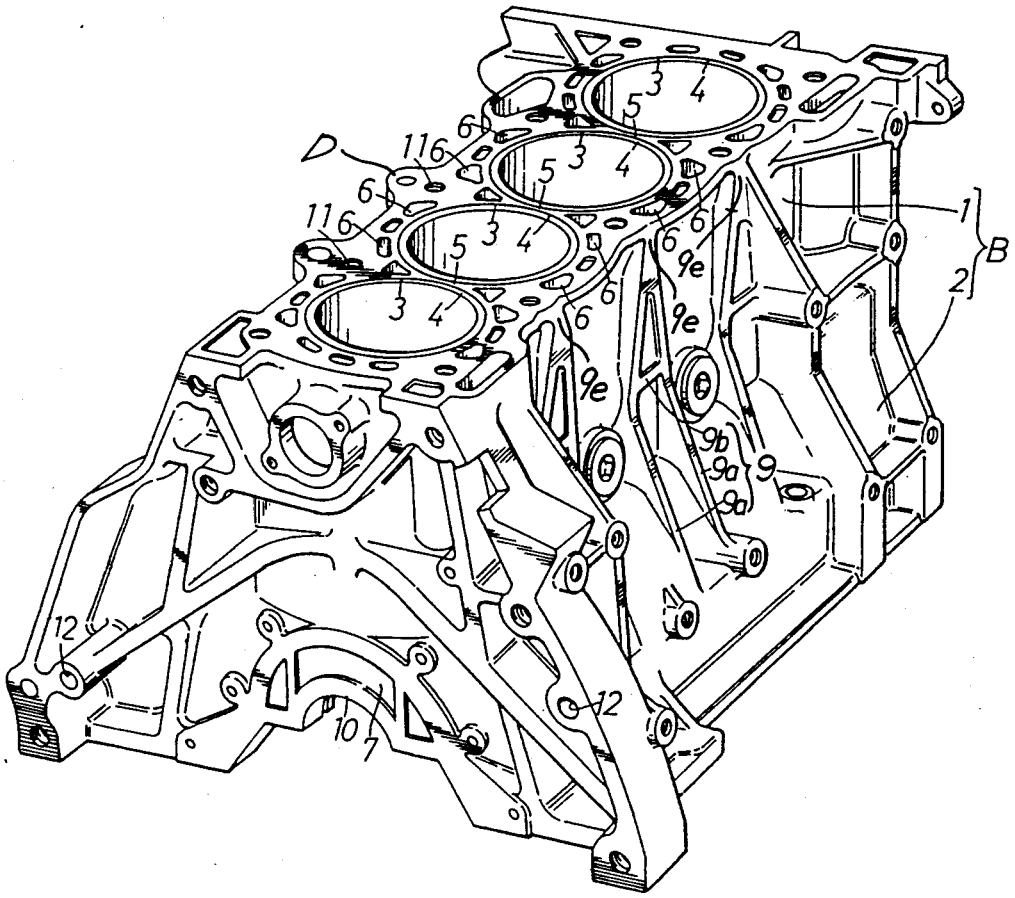
FIG. 1 is a perspective view of a cylinder block structure according to the present invention.
Figure 2:
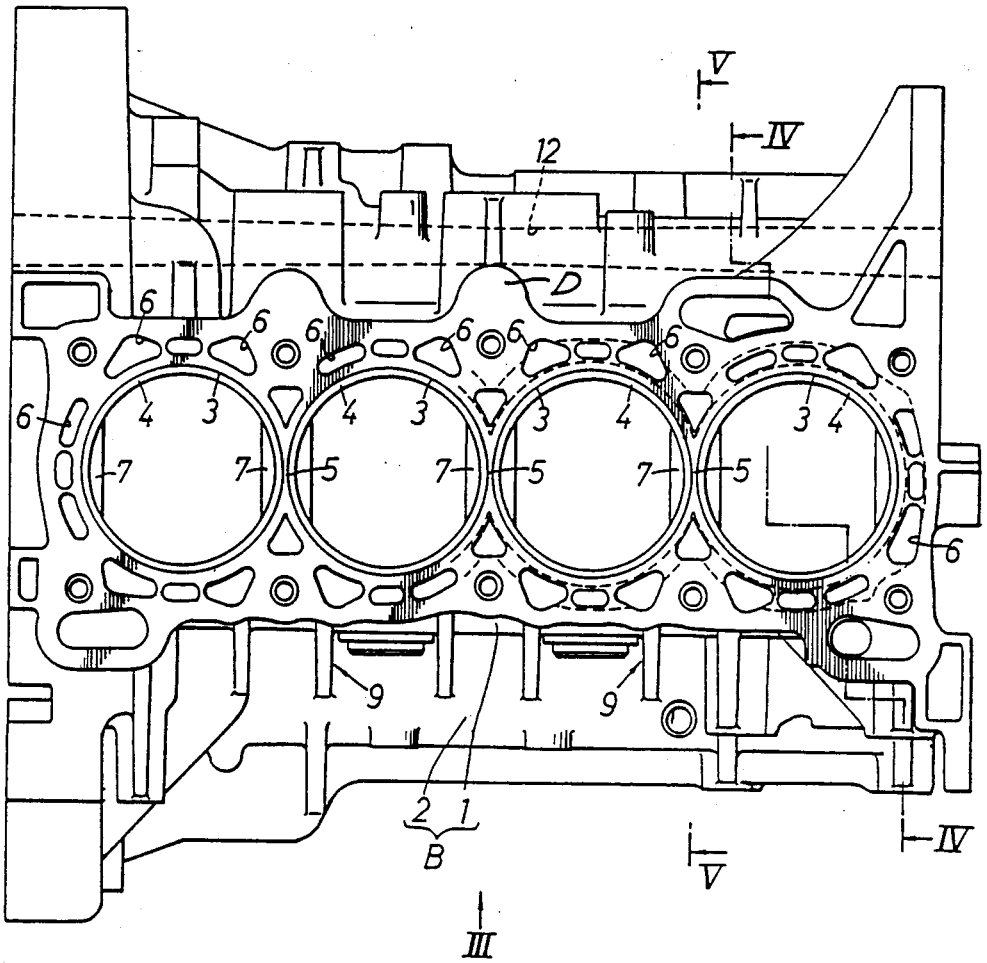
FIG. 2 is a top plan view of the cylinder block structure of FIG. 1.

FIGS. 1 through 5 illustrate a cylinder block structure according to the present invention incorporated in an in-line four-cylinder internal combustion engine, but it will readily appear to those skilled in the art that the present invention may be employed in engines having more or fewer cylinders and in different cylinder arrangements.

The closed-deck cylinder block, generally designated B, is integrally cast of an aluminum alloy by any convenient casting process such as that disclosed in U.S. Pat. Nos. 4,436,140 and 4,519,436. The cylinder block B generally comprises an upper cylinder-defining portion 1 and a lower crankcase-defining portion 2. The cylinder-defining portion 1 has four in-line cylinder bores 3 defined therein in the so-called Siamese configuration with no water jackets in the boundary walls 5 between the adjacent cylinder bores 3. A tubular cylinder liner 4 is fitted in each of the cylinder bores 3.

The cylinder-defining portion 1 also has a water jacket 6 defined in surrounding relation to the cylinder bores 3 except at the boundary walls 5 between the adjacent cylinder bores 3.

The lower crankcase-defining portion 2 of the cylinder block B has a plurality of integrally cast journal walls 7 spaced at intervals along the direction in which the cylinder bores 3 are arranged in a line, preferably with a journal wall located between each pair of adjacent cylinder bores 3 and at each end of the cylinder block B. The journal walls 7 each have a semicircular bearing recess 10 defined in the central lower surface thereof and opening downwardly for supporting a crankshaft Sc.

Figure 3:
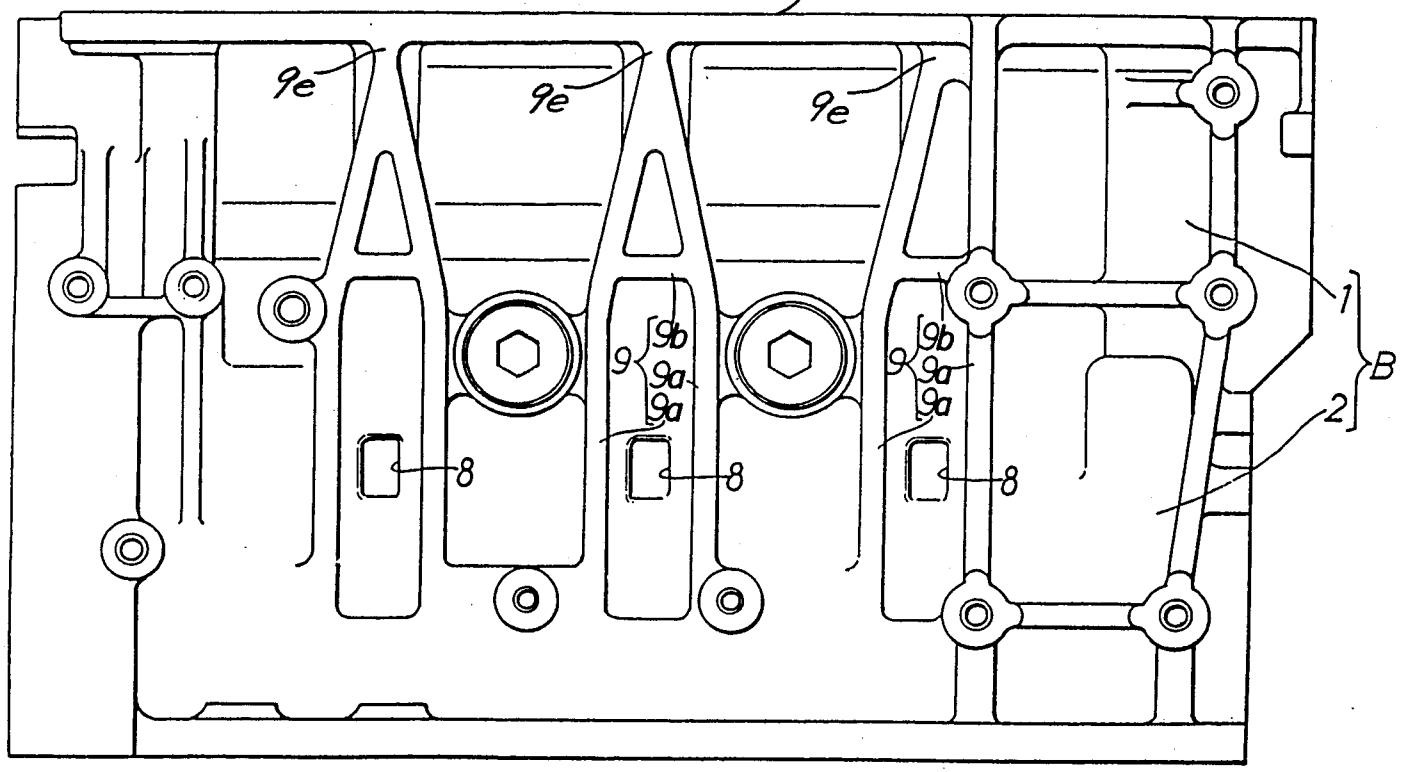
FIG. 3 is a side elevational view of the cylinder block, as seen in the direction of the arrow III in FIG. 2.
Figure 5:
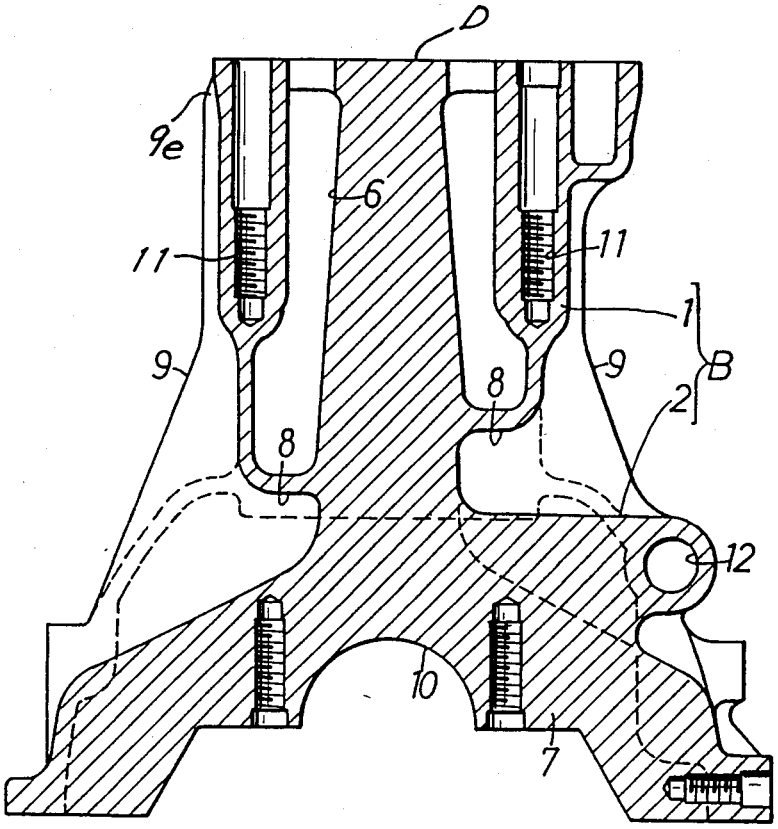
FIG. 5 is a cross-sectional view taken substantially along line V—V of FIG. 2.

As shown in FIGS. 3 and 5, the cylinder block B has concavities 8 defined in opposite sides thereof between each pair of adjacent cylinder bores 3. The concavities 8 extend vertically between the bottom of the water jacket 6 and the upper extremity of the journal walls 7, and outside of the boundary walls 5 between the cylinder bores 3. The concavities 8 serve to reduce any thick walls and solid blocks of the cylinder block B where a large amount of molten metal would be required during the casting process, so that the molten metal will solidify at a uniform speed when casting the cylinder block B, thereby to eliminate casting defects such as cavities in the cylinder block B.

The cylinder block B has a plurality of reinforcing rib systems 9 projecting transversely outwardly from the opposite sides thereof and extending vertically in generally parallel relationship with the central axes of the respective cylinder bores 3. As illustrated in FIG. 3, each of the reinforcing rib systems 9 is substantially A-shaped in surrounding relation to one of the concavities 8, and comprises a pair of substantially vertical ribs *9a* positioned one on each side of one of the concavities 8 and laterally spaced from each other, and a horizontal rib *9b* interconnecting the vertical ribs *9a* at relatively upper portions thereof to provide a sufficient degree of rigidity. The vertical ribs *9a* have a joined upper end portion *9e* which is progressively thinner toward and terminates just short of the upper surface of deck D of the cylinder block B (FIGS. 1, 3 and 5), the upper end *9e* being spaced from the deck D by a distance substantially equal to the thickness of each of the ribs *9a*, *9b* and *9e*.

Figure 4:
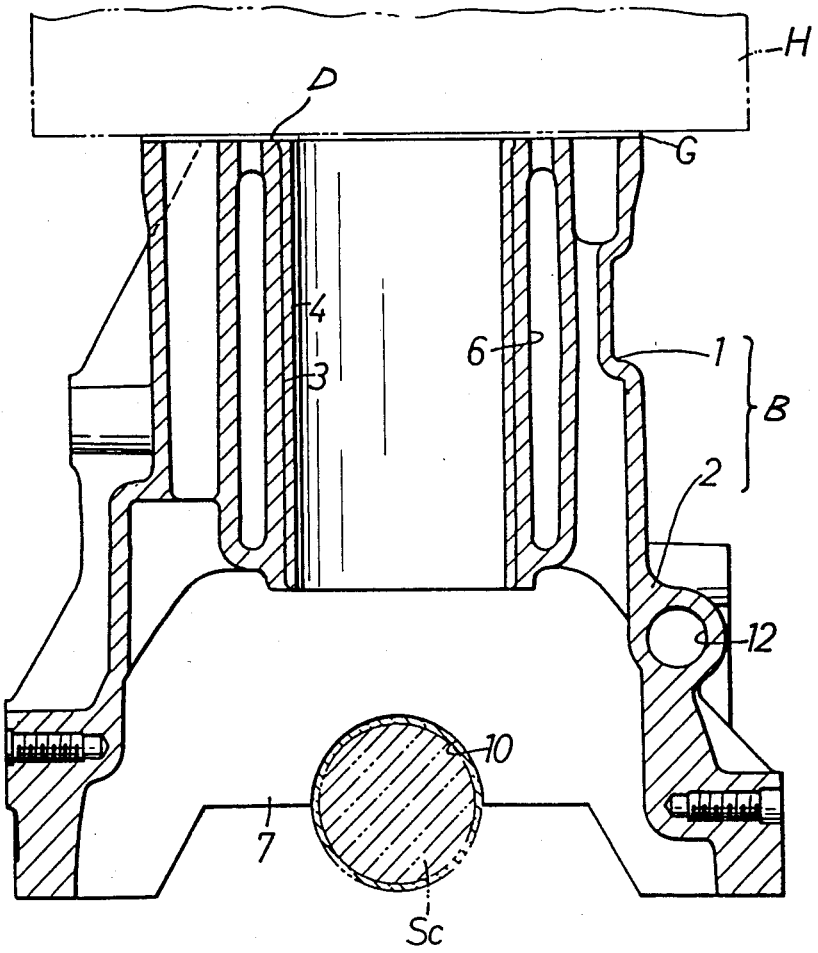
FIG. 4 is a cross-sectional view taken substantially along line IV—IV of FIG. 2.

As shown in FIG. 4, a cylinder head H is mounted on the deck D of the cylinder block B with gasket G interposed therebetween. The cylinder head H is fastened to the cylinder block B by bolts (not shown) threaded in bolt holes 11 (FIG. 5) in the cylinder block B. The cylinder block B is also provided with an oil gallery 12.

Since the explosion pressure generated in the cylinders during operation of the engine acts on the crankshaft Sc, the cylinder block B normally has relatively large thick walls and solid blocks of metal around the journal walls 7 which support the crankshaft Sc. However, such thick walls and blocks are reduced in volume by the concavities 8 defined between the water jacket 6 and the journal walls 7 by the present invention. Therefore, the amount of molten metal poured into such thick walls and blocks when the present cylinder block B is cast is reduced, and the speed at which the molten metal solidifies around the journal walls 7 is more uniform to thereby prevent casting defects such as cavities from being formed in the thick walls and blocks.

The reinforcing rib systems 9 projecting from the sides of the cylinder blocks B around the concavities 8 serve to stiffen the journal walls 7 which would otherwise be reduced in rigidity by the concavities 8 defined between the water jacket 6 and the journal walls 7. The reinforcing rib systems 9 sufficiently compensate for any reduction in the rigidity of the journal walls 7 due to the concavities 8. If the upper ends *9e* of the reinforcing rib systems 9 reached the deck D, the vibration of the cylinder block B would be transmitted through the rib systems 9 to the deck D. The deck D would then be caused to induce deflecting vibration which would develop a gap between the deck D and the gasket G which could cause the leakage of oil, gas and cooling liquid, and also the loosening of the bolts by which the cylinder head H and the cylinder block B are joined to each other. According to the illustrated embodiment, however, the upper ends *9e* of the reinforcing rib systems 9 terminate short of the deck D, and hence the vibration of the cylinder block B is not transmitted through the reinforcing rib systems 9 to the deck D. This eliminates the possible danger of fluid leakage between the cylinder block B and the gasket G and of loosening of the bolts. The reinforcing rib systems 9 are therefore only effective in stiffening the cylinder block B as desired.

The cylinder block B thus constructed is free from undesired casting defects, such as cavities, and is reinforced with the reinforcing rib systems 9 which are provided to compensate for any reduction in mechanical strength arising from the presence of the concavities 8. As a consequence, the cylinder block B is sufficiently mechanically strong to meet the higher loads resulting from higher operation speeds and higher power outputs of the engine, while at the same time the cylinder block B is lightweight. Any vibration of the reinforcing rib systems 9 is not transmitted to the deck D to any substantial degree, which therefore prevents the deck from being subject to deflecting vibration during operation of the engine.

Although a certain preferred embodiment has been shown and described, it should be understood that many changes and modifications may be therein without departing from the scope of the appended claims.

What is claimed is:

1. A cylinder block structure of a light alloy for use in a multi-cylinder internal combustion engine, comprising:

a cylinder-defining portion having a plurality of cylinder bores, a water jacket defined in surrounding relation to said cylinder bores and a deck for attachment to a cylinder head;

a crankcase-defining portion integrally formed with said cylinder-defining portion and having a plurality of integral journal walls spaced in the direction in which said cylinder bores are arranged;

means defining concavities in opposite sides of said cylinder- and crankcase-defining portions between the adjacent cylinder bores, said concavities lying between said water jacket and said journal walls; and a plurality of reinforcing rib systems projecting from said opposite sides with each rib system surrounding one of said concavities, each of said reinforcing rib systems extending substantially parallel to the central axes of said cylinder bores and having an upper end terminating short of said deck and each said reinforcing rib system having a substantially A-shaped configuration including a pair of laterally spaced substantially vertical ribs positioned one on each side of said concavities and a substantially horizontal rib interconnecting said vertical ribs.

2. A cylinder block structure according to claim 1, wherein said vertical ribs are joined to each other at said upper end and are progressively thinner toward said deck.

3. A cylinder block structure according to claim 1, wherein said upper end is spaced from said deck by a distance substantially equal to the thickness of said vertical and horizontal ribs.

* * * * *